US006312495B1

(12) United States Patent
Renner et al.

(10) Patent No.: US 6,312,495 B1
(45) Date of Patent: Nov. 6, 2001

(54) POWDER-METALLURGICALLY PRODUCED COMPOSITE MATERIAL AND METHOD FOR ITS PRODUCTION

(75) Inventors: Gerd Renner, Dachau; Udo Siefken, München, both of (DE)

(73) Assignee: Louis Renner GmbH, Dachau (DE)

( * ) Notice: Subject to any disclaimer, the term of this patent is extended or adjusted under 35 U.S.C. 154(b) by 0 days.

(21) Appl. No.: 09/545,361

(22) Filed: Apr. 7, 2000

(30) Foreign Application Priority Data

Apr. 9, 1999 (DE) ..... 199 16 082

(51) Int. Cl.[7] ..... B22F 3/00

(52) U.S. Cl. ..... 75/247; 75/248; 419/3; 419/5; 419/6; 419/23; 419/28; 419/47

(58) Field of Search ..... 75/247, 248; 419/3, 419/28, 47, 5, 6, 23

(56) References Cited

U.S. PATENT DOCUMENTS

| | | | | |
|---|---|---|---|---|
| 3,685,134 | * | 8/1972 | Blue . | |
| 3,992,199 | * | 11/1976 | Neely . | |
| 4,810,289 | * | 3/1989 | Hoyer et al. | 75/232 |
| 5,413,751 | * | 5/1995 | Polese et al. | 419/23 |
| 5,686,676 | * | 11/1997 | Jech et al. | 75/247 |
| 5,831,186 | * | 11/1998 | Oswood et al. | 75/243 |
| 5,846,288 | * | 12/1998 | Jost et al. | 75/243 |

FOREIGN PATENT DOCUMENTS

| | | |
|---|---|---|
| 1 106 965 | 2/1957 | (DE) . |
| 198 28 692 | 1/1999 | (DE) . |
| 0 806 489 A2 | 11/1997 | (EP) . |
| 55-044558 | 3/1980 | (JP) . |

OTHER PUBLICATIONS

Keil et al., *Elektrische Kontakte und ihre Werkstoffe*, Springer–Verlag, Berlin Title Page, Publication Page, and pp. 188, 192 and 193 (1984) (with a partial English language translation).

* cited by examiner

*Primary Examiner*—Ngoclan Mai
(74) *Attorney, Agent, or Firm*—Mueting, Raasch & Gebhardt, P.A.

(57) ABSTRACT

The present invention relates to a powder-metallurgically produced composite material comprising a matrix and a granular additive comprising at least one fine-grained refractory metal with an average grain size of at most 2 $\mu$m uniformly distributed in the matrix, so that the composite exhibits a residual porosity of <0.5%. Furthermore, the invention relates to a method for the production of the composite and its use as an electrical contact material.

22 Claims, 3 Drawing Sheets

Ag/W 60/40 wt.-%

1000:1

Ag/W 60/40 wt.-%

1000:1

Ag/W 50/50 wt.-%

1000:1

Ag/W 50/50 wt.-%

1000:1

Ag/W 50/50 wt.-%

1000:1

POWDER-METALLURGICALLY PRODUCED COMPOSITE MATERIAL AND METHOD FOR ITS PRODUCTION

This application claims the benefit of priority German Application No. 199 16 082.1, filed Apr. 9, 1999, which is hereby incorporated herein by reference in its entirety.

Tungsten-silver and molybdenum-silver composites have long been known as contact materials which are subjected to high electrical loads. These sinter materials combine the material consumption resistance of the high-melting refractory components W and Mo and the good electrical and thermal conductivity of the silver used as the matrix component.

Such contact materials are commonly used in low-voltage power engineering as blow-out contacts in power switches and as main contacts in safety switches.

Important properties of these materials include high wear resistance, material consumption resistance and a low tendency to weld. Therefore, these silver materials are suitable for applications in electromechanical switches which require extremely high breaking capacities.

Due to their composite nature (non-alloyability of the components W and Mo with the matrix metal Ag) and the high melting point of the refractory component, these materials can basically only be manufactured by means of a powder-metallurgical process. Since the material consumption resistance, hardness and conductivity directly depend on the number of pores of the material in question, and since furthermore the material consumption resistance and strength can be improved by decreasing the grain size of the refractory component in the composite, it has generally been attempted to produce as non-porous and fine-grained a material as possible.

According to the prior art, two sintering processes are available for producing such materials:

During liquid-phase or solid-phase sintering, a powder mixture which has the same composition as the desired end composition, is pressed into a formed piece (single-piece production) and sintered at temperatures above or below the Ag liquidus.

In the infiltration process, a porous formed piece made of tungsten or molybdenum, which was also pressed individually, is infiltrated with liquid matrix metal in order to obtain as non-porous, i.e. dense, a composite as possible due to the acting capillary forces.

The disadvantage of the first process is a relatively high remaining residual porosity which might necessitate further compression by means of recompacting. However, the degree of reshaping by recompacting is relatively low. As a consequence, a certain residual porosity remains.

In the second process, the residual porosity is lower, however, the excess of the infiltration metal has to be removed in an additional time-consuming metal-cutting process step. Cf. A. Keil et al., Elektrische Kontakte und ihre Werkstoffe, Berlin 1984, pages 192 et seqq.

The production of metallic composites by means of sintering is additionally made more difficult by the endeavor to improve the quality of the contact material by employing fine-grained refractory components. Fine-grained refractory metal powders have a significantly higher oxygen content than coarse-grained powders. This makes the wetting with the matrix metal more difficult which entails an increased formation of pores. Therefore, fine-grained materials tend to have a higher pore content than coarse-grained materials. Another difficulty is the handling of fine refractory metal powders having an average grain size in the range of <1 $\mu$m.

These powders become pyrophoric and tend to spontaneously smolder, incinerate or explode when handled in air.

Due to these properties it has become increasingly difficult to improve tungsten or molybdenum composites with respect to a small grain size combined with a high density of the material by means of conventional sintering technology alone.

Even after an aftertreatment consisting of reshaping steps such as recompacting by compression or the like, the residual porosity of the finished contact pieces still lies in the order of magnitude of percents. Fine-grained materials showed the least satisfactory results in this connection.

However, as a result of the pressure to miniaturize switch components while at the same time meeting the increasing demands on performance and lifetime, the quality of presently available contact pieces is no longer considered sufficient.

In the manufacture of metal composites, generally known reshaping processes can be applied after sintering by means of which, due to their large degree of reshaping, the residual porosity of the obtained materials can be brought down to below the known value. For this purpose, the person skilled in the art can choose from e.g. extrusion, rolling and forging processes. By means of these processes dense and high-quality products can be obtained. The starting material is a powder mixture which is isostatically pressed into rods, subsequently sintered and then reshaped by hot extrusion or hot rolling. In the case of extrusion, the obtained semi-finished product is usually formed by rolling. The high degree of reshaping provided by both processes results in a strong compression of the material. Compression and quality of the material are directly linearly dependent on each other (cf. A. Keil, loc. cit., page 188).

From a technological point of view, a material obtained by extrusion has the further advantage over single-piece production that a continuous section is obtained, which in addition can be plated during production with a solder suitable for the technology of joining materials. This continuous tape can then be integrated directly in the product line at the switch maker's. The desired contact coating is cut off, fed to the carrier and connected thereto for example by means of resistance soldering.

The disadvantage of both reshaping processes is that the starting rods which are subjected to the reshaping have to be sufficiently ductile. Otherwise, the pressing or rolling equipment or the sections to be produced could be damaged during reshaping. In the case of flat sections, cracking or chipping at the edges can occur. It might not be possible to extrude workpieces that are too brittle at all, not even in a heated state. In any case, such flaws preclude a high quality of the material.

What additionally complicates the matter is that particularly composites which are of special technical interest require a high amount of refractory component in the material. However, an increased amount of brittle and hard grains in the ductile matrix renders the entire workpiece brittle and thus unsuitable for reshaping.

Furthermore, it is the prevailing opinion among experts that the difficulties in extrusion increase with the decrease of the grain size in the matrix. This opinion makes the extrusion molding method seem hardly suitable for fine-grain materials. The document DE-A-198 28 692 discloses a process to render a commercially available $SnO_2$ powder more coarse from 0.6 $\mu$m to more than 5 $\mu$m so that it may be reshaped more easily by means of extrusion molding in an Ag matrix as $AgSnO_2$ composite.

Consequently, according to the prior art, the reshaping technology of WAg or MoAg composites is restricted to a high silver content range which is of secondary technological and economic interest.

Although on page 193, loc. cit., A. Keil also describes the extrusion molding of WAg sinter blocks produced by sintering powder mixtures below the melting point of silver, the extrusion moldability of WAg is considered limited at tungsten contents of ≦30 wt.-%. In Keil's view, due to the high Ag content, no stable W skeleton can be formed which would render the material brittle. The sintered body retains its sufficiently high ductility and can be extrusion molded.

JP-A-55 044558 discloses the extrusion of a heat-resistant, conductive material consisting of a copper oxide or silver oxide alloy in the form of particles and W or Mo in the form of particles which are combined, sintered and extruded. This results in the surface of the W or Mo being coated with Cu or Ag alloy. Neither the production method nor the application of this teaching is aimed at composites suitable for electric contact materials.

EP-A-0 806 489 discloses a process for producing a composite containing copper and a transition metal, said process comprising sintering a compact of copper-containing particles and transition metal-containing particles wherein said transition metal is preferably selected from the group consisting of tungsten and molybdenum in a reducing atmosphere, said compact containing chemically-bound oxygen in an amount sufficient to improve sintering of said compact. After sintering is complete, the composite so formed can be removed from the sintering furnace and used as is in a variety of different electrical applications, preferably for electronic packaging applications.

DE-A-1 106 965 discloses a process for the preparation of molded articles with high density from a silver composite material, said molded articles preferably exhibiting a sintering density of at least 95% and a repressing density of at least 99.8% of the compact density, characterized in that the pressed molded article is subjected to a presintering step under a hydrogen atmosphere, wherein temperature and time are determined such that the molded article remains permeable to gas, and in that the molded article is subsequently heated to the sintering temperature, which is to be selected between 850° C. and the melting point of the silver, in vacuo for one hour and dense sintered without repressing, and the molded article is subsequently repressed. This document does not provide any particulars regarding the grain size of the refractory component. Although molybdenum and tungsten are mentioned as added metals, merely the ductile Ni in admixture with Ag is used in the examples.

To sum up the present state of the art, it can be noted that contact pieces made from WAg and MoAg comprising the technologically interesting ratios of W/Ag of from 70 wt.-% W/30 wt.-% Ag to 30 wt.-% W/70 wt.-% Ag and Mo/Ag of from 70 wt.-% Mo/30 wt.-% Ag to 30 wt.-% Mo/70 wt.-% Ag can only be manufactured by means of single-piece pressing technology. High-quality pieces, i.e. dense, non-porous and thus material consumption resistant embodiments, require additional extensive and expensive process steps.

Essentially non-porous WAg and MoAg composites which are inexpensively manufactured on an industrial scale by means of the alternative extrusion molding method are only known in the prior art with a tungsten or molybdenum content of ≦30 wt.-%.

So far, extrusion molding methods have not been applied for the manufacture of materials in power engineering having a W or Mo content of more than 30 wt.-%, i.e. materials having a high resistance to material consumption.

It is therefore an object of the present invention to develop a contact material the manufacture of which is inexpensive and which also exhibits improved properties, i.e. a fine-grained, uniformly distributed refractory content in the metal matrix in combination with as low a residual porosity as possible. A material is to be provided which can meet the increasing demands on breaking capacity and lifetime (number of operations), in particular in low-voltage power engineering. The invention should encompass the entire range of technologically important compositions. The compositions W/Ag 40/60 wt.-% to W/Ag 60/40 wt.-% and MoAg 40/60 wt.-% to MoAg 60/40 wt.-% are of particular interest. Regarding its physical and technological properties, the material should be superior to materials manufactured according to the prior art and should offer advantages with respect to handling and costs to the switch maker in connection with the assembly of the switches.

Another object underlying the present invention is to provide a method for the production of such a contact material which by means of a high degree of reshaping guarantees the desired compression of the material to a residual porosity of <0.5%.

These objects were achieved based on the surprising finding that by using a particularly fine-grained refractory metal, high degrees of reshaping can be achieved which lead to the desired low residual porosity.

Therefore, the invention is directed to a powder-metallurgically produced composite comprising a matrix comprising silver and a granular additive comprising at least one refractory metal (refractory component) in said matrix, characterized in that the refractory component has an average grain size of at most 2 μm, is uniformly distributed in the matrix and that the composite exhibits a residual porosity of <0.5%.

Preferred embodiments of the composite material form the subject-matter of claims 1 to 6.

In one embodiment of the invention the powder-metallurgically produced composite of the invention is in the shape of a flat strip or continuous tape and in that case the matrix may be made from silver or copper. This strip or tape can be plated with hard solder.

Another subject-matter of the invention is a method for the production of a composite material according to the invention, characterized in that a powdered mixture comprising at least one refractory metal having an average grain size of at most 2 μm and silver as matrix metal and optionally a sintering aid are compressed and sintered in a solid or liquid phase at a temperature above 600° C. such that a sintering shrinkage of 10 to 50 vol.-% occurs and that the obtained sintered body is subjected to reshaping such that the residual porosity is <0.5%.

Preferred embodiments of the method form the subject-matter of claims 10 to 13.

Finally, the invention is directed to the use of a composite material according to the invention as electrical contact material.

Preferably the matrix consists essentially of silver. In one embodiment, the matrix may also consist essentially of copper.

The research leading to the present invention has surprisingly shown that the use of increasingly fine-grained refractory powders has the effect that metal composites with increasingly high amounts of refractory components can be extrusion-molded. Apparently, a particularly fine refractory grain decreases the ductility of the sintered body much less than was previously assumed in the prior art. Thus, rods comprising the preferred refractory component W or Mo in amounts of >30 wt.-% or more, e.g. the preferred amount of 40 to 60 wt.-%, or even up to 70 wt.-% of refractory metal, can be extrusion-molded in the Ag matrix.

The inventors assume that due to the sintering shrinkage, fine-grained refractory metal powders can be welded more easily to the matrix metal particles during sintering than coarser refractory metal particles. This should improve the suppleness and thus the ductility of the composite.

Starting from the coarser grain sizes common in the prior art, the use of the fine-grained refractory metal powders in combination with a high degree of reshaping by means of extrusion molding, rolling or reforging results in the desired improvement of the physical and technological properties relevant for power engineering.

- Fine grains offer the general advantage of a reduced material consumption in combination with improved extinguishing properties.
- The density of the material approaches the theoretical value (i.e. the porosity approaches zero), the material reaches an ideal density. Again, this entails the advantage of reduced material consumption and reduced wear.
- The conductivity is increased and also lies in the range of the theoretical conductivity calculated according to the logarithmic formula with respect to the mixing ratio of the components. This has the advantage that parallel to electrical conductivity, an improved thermal conductivity is achieved: The heat generated by the electric arc during switching can more easily be dissipated. The contact pieces have a reduced tendency to overheat.
- Even in the soft-annealed state (i.e. as in the soldered switching contact), the Vickers hardness lies clearly above the values of the materials known from the prior art. This is advantageous with respect to wear and deformation in connection with the required very high number of operations.

For producing the composite materials of the present invention, a refractory metal, preferably W or Mo, is added in powdermetallurgical manner to at least one of the matrix metals Ag and Cu such that the refractory component preferably accounts for 30 to 70 wt.-% of the mixture. The refractory metal powder has to be fine-grained, having an average grain size of at most 2 $\mu$m, preferably 0.1 to 1 $\mu$m. As an additive, a maximum of 6 wt.-% of a pulverized sintering aid such as Ni, Co or Fe can be added. The weighed-in powders are homogenized by means of a process known to the person skilled in the art and are then isostatically compressed into round rods. The obtained green compact is sintered under protective gas at a temperature above 600° C. such that a sintering shrinkage (volume contraction) of at least 10% occurs.

The obtained sintered body, which is still porous, is subjected to inductive heating and reduced to a desired cross-section by means of a suitable reshaping process such as extrusion molding (forward extrusion), rolling or reforging. Subsequent finishing rolling and optional plating with hard solder yields the section of the desired shape (preferably a flat strip) which is wound onto a spool as a continuous tape. The residual porosity of the finished material is <0.5%.

The following examples describe some preferred embodiments of the present invention without restricting the invention in any way:

EXAMPLE 1

Ag/W 60/40 wt.-%

60 parts by weight of fine Ag powder having a grain size of <60 $\mu$m are mixed with 40 parts by weight of fine submicron tungsten metal powder under protective gas and ground in a suitable manner (e.g. in a ball mill) under protective gas. The thus homogenized powder mixture is isostatically compressed into round rods and sintered at a temperature of 700° C. The sintering shrinkage was found to be 36 vol.-%.

The finished sintered rod has a density of 12.0 g/cm$^3$. This corresponds to a residual porosity of 7%.

The rod is heated to about 700° C. under protective gas and is then extruded in a heated state into two strands of a 3 mm diameter each by means of forward extrusion molding.

The obtained strands are subsequently processed to a thickness of 1 mm by means of finishing rolling or, directly after extrusion molding, roll-bonded with a suitable Ag hard solder and then finished by rolling to the desired thickness.

Every rolling process is followed by subsequent deburing and soft annealing.

The obtained strand with a 5×1 mm cross-section was found to exhibit the following chemical and physical properties. They were compared with typical values of the prior art (AgW 60/40 wt.-%, single-piece production, sintered in liquid phase).

Figure 1:
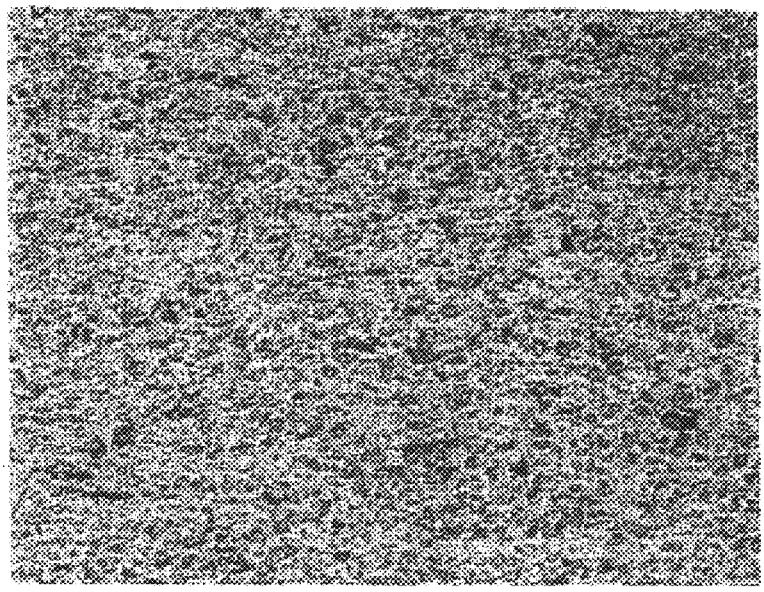
FIG. 1: micrograph of a polished section, longitudinal section, strips of AgW 60/40 wt.-%, extrusion-molded.
Figure 2:
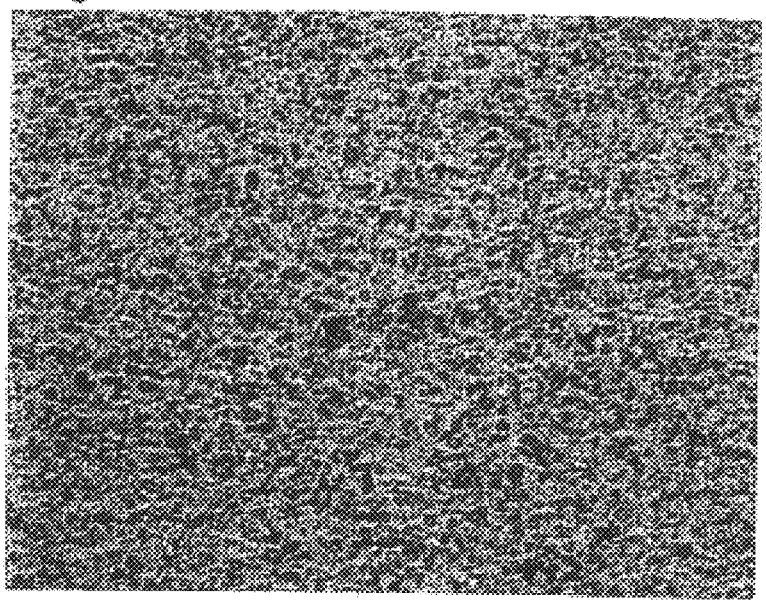
FIG. 2: micrograph of a polished section, cross-section, strips of AgW 60/40 wt.-%, extrusion-molded.

| | | | Invention | State of the art |
|---|---|---|---|---|
| Ag analysis: | [wt.-%] | = | 59.5 | (60) |
| Density: | [g/cm$^3$] | = | 12.85 | 12.4 |
| (theoretical | [g/cm$^3$] | = | 12.9) | |
| Residual porosity | [%] | = | 0.4 | 3.9 |
| Conductivity | [m/Ωmm$^2$] | = | 44.3 | 39.5 |
| (theoretical | [m/Ωmm$^2$] | = | 44.9) | |
| Hardness [HV] soft annealed: | | | 122 | 105 |
| Micrograph longitudinal/ transverse | | | FIG. 1/ FIG. 2 | |

The distribution of the W in the Ag matrix is very uniform. The material is practically non-porous. Despite the extreme stretching in one direction resulting from the extrusion molding process and the rolling process, the longitudinal section only shows little formation of band in its texture. In other words, the material does not show a preferred direction in the arrangement of the W grains in the Ag matrix. It is practically isotropic in all three dimensions, i.e. the distribution is optimal.

EXAMPLE 2

Ag/W 50/50 wt-%

Similarly as in Example 1, 50 parts by weight of fine Ag powder having a grain size of <60 $\mu$m are mixed with 50 parts by weight of submicron tungsten metal powder, ground and compressed into round rods. Again, the obtained green compact is sintered at a temperature of 700° C. such that the sintering shrinkage was 38.7 vol.-%. As sintering aid, 4 wt.-% Ni was added. The sintered rod has a density of 12.7 g/cm$^3$. This corresponds to a residual porosity of 8%.

Extrusion molding, rolling and plating was carried out similarly as in Example 1.

The obtained strand with a 5×1 mm cross-section was found to exhibit the following chemical and physical properties. They were compared with typical values of the prior art (AgW 50/50 wt.-%, single-piece production, sintered in liquid phase).

Figure 3:
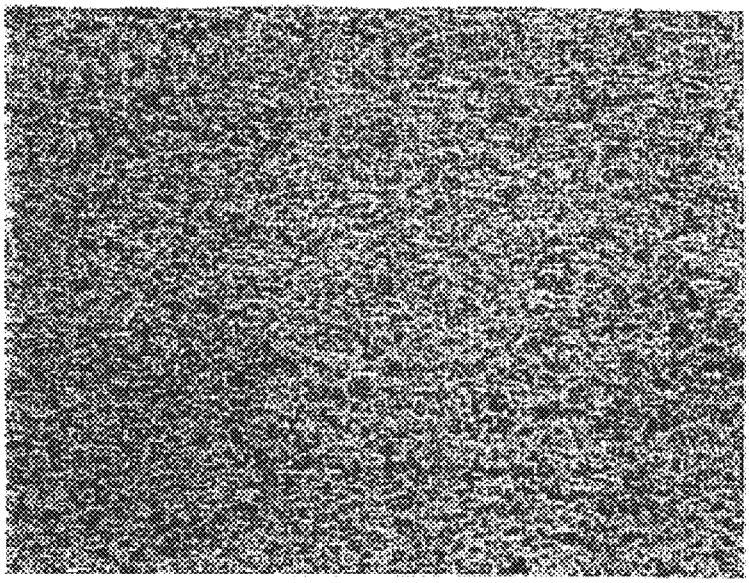
FIG. 3: micrograph of a polished section, longitudinal section, strips of AgW 50/50 wt.-%, extrusion-molded.
Figure 4:
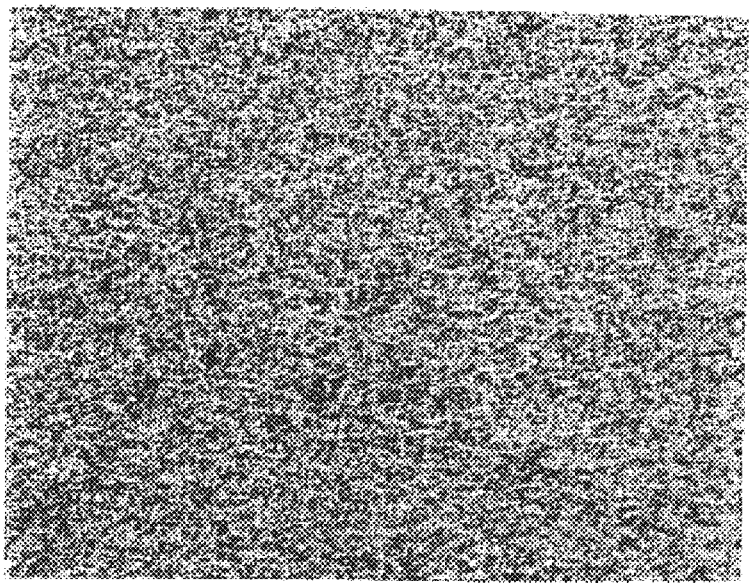
FIG. 4: micrograph of a polished section, cross-section, strips of AgW 50/50 wt.-%, extrusion-molded.

| | | | Invention | State of the art |
|---|---|---|---|---|
| Ag analysis: | [wt.-%] | = | 49.6 | (50) |
| Density: | [g/cm$^3$] | = | 13.75 | 13.4 |
| (theoretical | [g/cm$^3$] | = | 13.8) | |
| Porosity | [%] | = | 0.37 | 2.9 |
| Conductivity | [m/Ωmm$^2$] | = | 40.2 | 35.9 |
| (theoretical | [m/Ωmm$^2$] | = | 40.4) | |
| Hardness [HV], soft annealed | | = | 152 | 130 |
| Micrograph longitudinal/ transverse | | | FIG. 3/ FIG. 4 | |

Distribution, non-porosity and isotropy similar as in Example 1.

Figure 5:
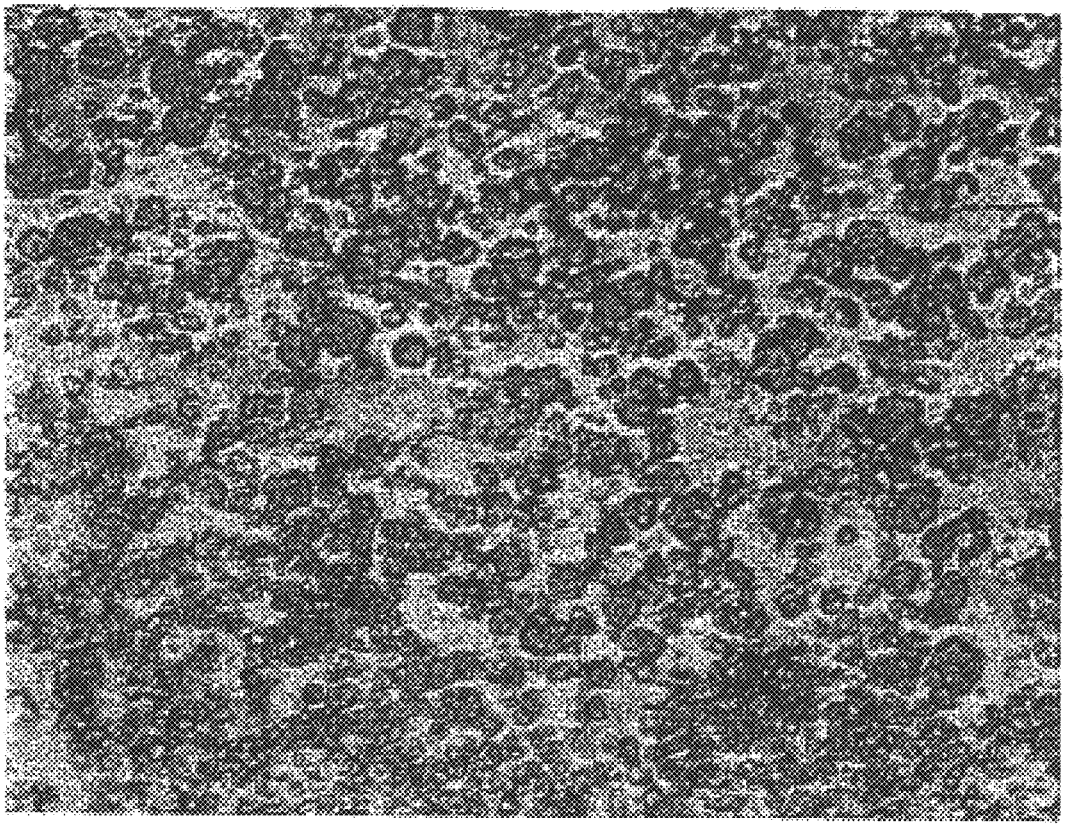
FIG. 5: micrograph of a polished section, contact platelet of AgW 50/50 wt.-%, single-piece production, liquid-phase sintering. Prior art as comparison.

The improvements with respect to grain size, distribution and lack of pores can easily be seen in the comparison with a section according to the prior art (AgW 50/50 wt.-%, single-piece production, sintered in liquid phase) (cf. FIG. 5).

What is claimed is:

1. A powder-metallurgically produced composite material comprising a matrix comprising silver and a granular additive comprising at least one refractory component in said matrix, wherein the refractory component has an average grain size of at most 2 μm, is uniformly distributed in the matrix, and the composite exhibits a residual porosity of less than 0.5%.

2. The composite material according to claim 1, wherein the refractory component is present in an amount of greater than 30 wt.-% to 70 wt.-%, based on the total mass of the composite material.

3. The composite material according to claim 1, wherein the refractory component comprises at least one of the metals W and Mo.

4. The composite material according to claim 1, wherein the refractory component has an average grain size of 0.1–1.0 μm.

5. The composite material according to claim 1, wherein a metal which forms an alloy both with the refractory component and the matrix metal is added in an amount from 0.1 wt.-% to 6 wt.-% as a sintering aid.

6. The composite material according to claim 5, wherein the sintering aid comprises Ni, Co or Fe.

7. A powder-metallurgically produced composite material in the form of a flat strip or continuous tape comprising a matrix comprising at least one of the matrix metals silver and copper and a granular additive comprising at least one refractory component in said matrix, wherein the refractory component has an average grain size of at most 2 μm, is uniformly distributed in the matrix, and the composite exhibits a residual porosity of less than 0.5%.

8. The composite material according to claim 7, wherein the refractory component is present in an amount of greater than 30 wt.-% to 70 wt.-%, based on the total mass of the composite material.

9. The composite material according to claim 7, wherein the refractory component comprises at least one of the metals W and Mo.

10. The composite material according to claim 7, wherein the refractory component has an average grain size of 0.1–1.0 μm.

11. The composite material according to claim 7, wherein a metal which forms an alloy both with the refractory component and the matrix metal is added in an amount from 0.1 wt.-% to 6 wt.-% as a sintering aid.

12. The composite material according to claim 11, wherein the sintering aid comprises Ni, Co or Fe.

13. The composite material according to claim 7, wherein the composite material is plated with hard solder.

14. A method for the production of a composite material according to claim 1, the method comprising:

compressing and sintering a powdered mixture comprising at least one refractory metal having an average grain size of at most 2 μm and silver as matrix metal and optionally a sintering aid in a solid or liquid phase at a temperature above 600° C. to form a sintered body, such that a sintering shrinkage of 10 to 50 vol.-% occurs; and reshaping the sintered body such that the residual porosity is less than 0.5%.

15. The method according to claim 14, wherein the sintering shrinkage is 30–40 vol. %.

16. The method according to claim 14, wherein the reshaping is carried out by means of extrusion molding, rolling or reforging.

17. A method for the production of a composite material according to claim 7, the method comprising:

compressing and sintering a powdered mixture comprising at least one refractory metal having an average grain size of at most 2 μm and at least one of silver and copper as matrix metal and optionally a sintering aid in a solid or liquid phase at a temperature above 600° C. to form a sintered body, such that a sintering shrinkage of 10 to 50 vol.-% occurs; and rolling the sintered body such that the residual porosity is less than 0.5% to form a flat strip or a continuous tape.

18. The method according to claim 17, wherein the flat strip or the continuous tape is plated with a suitable solder.

19. An electrical contact material comprising a powder-metallurgically produced composite material comprising a matrix comprising at least one of silver and copper and a granular additive comprising at least one refractory component in said matrix, wherein the refractory component has an average grain size of at most 2 μm, is uniformly distributed in the matrix, and the composite exhibits a residual porosity of less than 0.5%.

20. The electrical contact material of claim 19 wherein the matrix comprises silver.

21. The electrical contact material of claim 20 wherein the composite material is in the form of a flat strip or continuous tape.

22. The electrical contact material of claim 20 wherein the composite material is plated with hard solder.

* * * * *